US011332287B2

(12) United States Patent
Marina et al.

(10) Patent No.: US 11,332,287 B2
(45) Date of Patent: May 17, 2022

(54) BEVERAGE CONTAINER AND CAP

(71) Applicant: PepsiCo, Inc., Purchase, NY (US)

(72) Inventors: Carlos Hernan Marina, Key Biscayne, FL (US); Michel Alvarez, Miami, FL (US)

(73) Assignee: PepsiCo, Inc., Purchase, NY (US)

( * ) Notice: Subject to any disclaimer, the term of this patent is extended or adjusted under 35 U.S.C. 154(b) by 16 days.

(21) Appl. No.: 16/527,973

(22) Filed: Jul. 31, 2019

(65) Prior Publication Data

US 2021/0031992 A1 Feb. 4, 2021

(51) Int. Cl.
*B65D 51/28* (2006.01)
*B65D 1/02* (2006.01)

(52) U.S. Cl.
CPC ..... *B65D 51/2821* (2013.01); *B65D 1/0246* (2013.01)

(58) Field of Classification Search
CPC .... B65D 51/24; B65D 51/28; B65D 51/2807; B65D 51/2814; B65D 51/2821; B65D 51/2828; B65D 51/2835; B65D 51/2842; B65D 51/285; B65D 51/2857; B65D 51/2864; B65D 51/2871; B65D 51/2878; B65D 51/2885; B65D 51/2892; B65D 1/02; B65D 1/0223; B65D 1/023; B65D 1/0246; B65D 81/32; B65D 81/3205; B65D 85/8043; B65D 41/32; B65D 47/36; B65D 47/38; B65D 43/0235; B65D 53/02; B65D 1/0276; B67D 3/0019
See application file for complete search history.

(56) References Cited

U.S. PATENT DOCUMENTS 4,474,312 A * 10/1984 Donoghue ..... G01F 11/286 222/205
5,792,496 A * 8/1998 Fekete ..... A23G 3/50 220/4.21
2006/0237095 A1* 10/2006 Johns ..... B65D 81/3211 141/329
2008/0290061 A1 11/2008 Seelhofer
2008/0314775 A1 12/2008 Owoc
2010/0055252 A1 3/2010 Marina et al.
(Continued)

FOREIGN PATENT DOCUMENTS

WO WO 2009/057940 A1 5/2009
WO WO 2018/112516 A1 6/2018

OTHER PUBLICATIONS

International Search Report and Written Opinion of the International Searching Authority in International Application No. PCT/US2020/042053, dated Sep. 28, 2020 (8 pages).

*Primary Examiner* — Ericson M Lachica
(74) *Attorney, Agent, or Firm* — Sterne, Kessler, Goldstein & Fox P.L.L.C.

(57) ABSTRACT

A reusable beverage container that includes a vessel having an upper end defining an upper opening and that is configured to store a beverage. The reusable beverage container further includes a cap that is removably securable to the upper end of the vessel, and the cap is configured to receive and completely enclose a beverage-ingredient cartridge. The cap of the reusable beverage container includes a lower shell defining a lower opening, an upper shell removably securable to the lower shell, and a cartridge opener extending from the lower shell.

20 Claims, 8 Drawing Sheets

(56) References Cited

U.S. PATENT DOCUMENTS

| | | | | |
|---|---|---|---|---|
| 2011/0166910 | A1* | 7/2011 | Marina | B65D 81/32 705/7.29 |
| 2012/0181269 | A1* | 7/2012 | Rubenson | A45C 9/00 220/4.24 |
| 2012/0241446 | A1* | 9/2012 | Schwartz | B65D 7/04 220/4.21 |
| 2013/0047559 | A1* | 2/2013 | Minnette | B65D 43/0212 53/471 |
| 2015/0050393 | A1* | 2/2015 | Chen | A47G 19/16 426/115 |
| 2016/0068334 | A1* | 3/2016 | Cafaro | B65D 77/08 426/115 |
| 2017/0354289 | A1 | 12/2017 | Marina et al. | |
| 2018/0168180 | A1* | 6/2018 | Vaccarella | A23G 1/545 |

* cited by examiner

BEVERAGE CONTAINER AND CAP

FIELD

Embodiments described herein generally relate to a beverage container and a cap for the beverage container. Specifically, embodiments described herein relate to a beverage container having a cap removably securable to the beverage container that is configured to dispense beverage ingredients from a beverage-ingredient cartridge into the beverage container.

BRIEF SUMMARY

Some embodiments are directed to a reusable beverage container that includes a vessel having an upper end that defines an upper opening, wherein the vessel is configured to store a beverage. The reusable beverage container further includes a cap removably securable to the upper end of the vessel, wherein the cap is configured to receive and completely enclose a beverage-ingredient cartridge. The cap of the reusable beverage container includes a lower shell defining a lower opening, an upper shell removably securable to the lower shell, and a cartridge opener extending from the lower shell.

In any of the various embodiments discussed herein, the vessel may include a body portion and a neck portion removably securable to the body portion, wherein the neck portion defines the upper opening at the upper end of the vessel, and the neck portion may have a first diameter at a lower end of the neck portion and a second diameter at an upper end of the neck portion, wherein the first diameter is greater than the second diameter.

In any of the various embodiments discussed herein, the lower shell may include a neck having threading that is configured to be removably secured to threading on the upper end of the vessel. In some embodiments, the lower shell includes a recess surrounding the neck configured to receive a lip of an upper end of the vessel.

In any of the various embodiments discussed herein, when the lower shell is secured to the vessel, a neck of the lower shell extends into the upper opening of the vessel.

In any of the various embodiments discussed herein, the lower shell may include an inner seal arranged on an interior surface of the lower shell, wherein the inner seal is configured to form a seal with a beverage-ingredient cartridge when the beverage-ingredient cartridge is positioned within the lower shell and in contact with the inner seal so as to prevent liquid from passing through the lower opening and into an interior volume of the cap outside of the beverage-ingredient cartridge.

In any of the various embodiments discussed herein, the cartridge opener may extend from the lower shell around the lower opening toward an upper end of the lower shell.

In any of the various embodiments discussed herein, the cap further includes a connection ring at an upper end of the lower shell that defines a groove configured to receive a ridge of the upper shell to removably secure the upper shell to the lower shell via a snap-fit connection.

In any of the various embodiments discussed herein, the lower shell may widen from a lower end of the lower shell toward an upper end of the lower shell.

In any of the various embodiments discussed herein, the cap may have a maximum diameter that is about 20% to 70% greater than a diameter of the upper opening of the vessel.

Some embodiments described herein relate to a system for making a beverage that includes the reusable beverage container as described herein, and a beverage-ingredient cartridge containing a beverage ingredient. When the beverage-ingredient cartridge of the system is engaged with the cartridge opener of the cap, the cartridge opener displaces a portion of the beverage-ingredient cartridge so as to release a beverage ingredient through the opening of the beverage-ingredient cartridge and into the vessel of the beverage container under the force of gravity.

Some embodiments are directed to a cap for a beverage container that includes a lower shell defining a lower opening, wherein the lower shell is removably securable to an upper end of a vessel, and wherein the lower shell widens from a lower end toward an upper end of the lower shell. The cap further includes an upper shell removably securable to the lower shell so as to define an interior volume bounded by the lower shell and the upper shell for receiving a beverage-ingredient cartridge. The cap also includes a cartridge opener extending from a lower end of the lower shell toward an upper end of the lower shell.

In any of the various embodiments discussed herein, the lower shell may include an inner seal having an annular shape, wherein the inner seal is arranged on an interior surface of the lower shell.

In any of the various embodiments discussed herein, the cap may be divided into the lower shell and the upper shell by a plane that is transverse to a longitudinal axis of the cap.

Some embodiments are directed to a reusable beverage container that includes a vessel having an opening and that is configured to store a beverage, and a cap removably securable to the vessel to seal the opening. The cap of the reusable beverage container includes a lower shell defining a lower opening such that an interior volume of the cap is connected with an interior volume of the vessel, and wherein the lower shell is configured to receive a beverage-ingredient cartridge containing a beverage ingredient. The cap of the reusable beverage container includes a cartridge opener extending from lower shell that is configured to contact the beverage-ingredient cartridge received by the lower shell such that when a force is applied to the beverage-ingredient cartridge, the cartridge opener dispenses the beverage ingredient from the beverage-ingredient cartridge into the vessel. The cap of the reusable beverage container further includes an upper shell removably securable to the lower shell.

In any of the various embodiments discussed herein, when the upper shell is removably secured to the lower shell, the beverage-ingredient cartridge may be enclosed within the cap.

In any of the various embodiments discussed herein, when the upper shell is secured to the lower shell, the upper shell may apply a force on the beverage-ingredient cartridge such that the beverage-ingredient cartridge pushes against the cartridge opener.

In any of the various embodiments discussed herein, the cartridge opener may be configured to extend into an interior volume of the beverage-ingredient cartridge in order to dispense the beverage ingredient from the beverage-ingredient cartridge.

Some embodiments are directed to a system for making a beverage that includes the reusable beverage container as described herein and a beverage-ingredient cartridge containing a beverage ingredient. When the beverage-ingredient cartridge of the system is engaged with the cartridge opener, the cartridge opener displaces a portion of the beverage-ingredient cartridge so as to release a beverage ingredient through the opening of the beverage-ingredient cartridge and into the beverage container under the force of gravity.

In any of the various embodiments discussed herein, the upper shell may be secured to the lower shell once the cartridge opener displaces a portion of the beverage-ingredient cartridge.

BRIEF DESCRIPTION OF THE DRAWINGS/FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION

Figure 1:
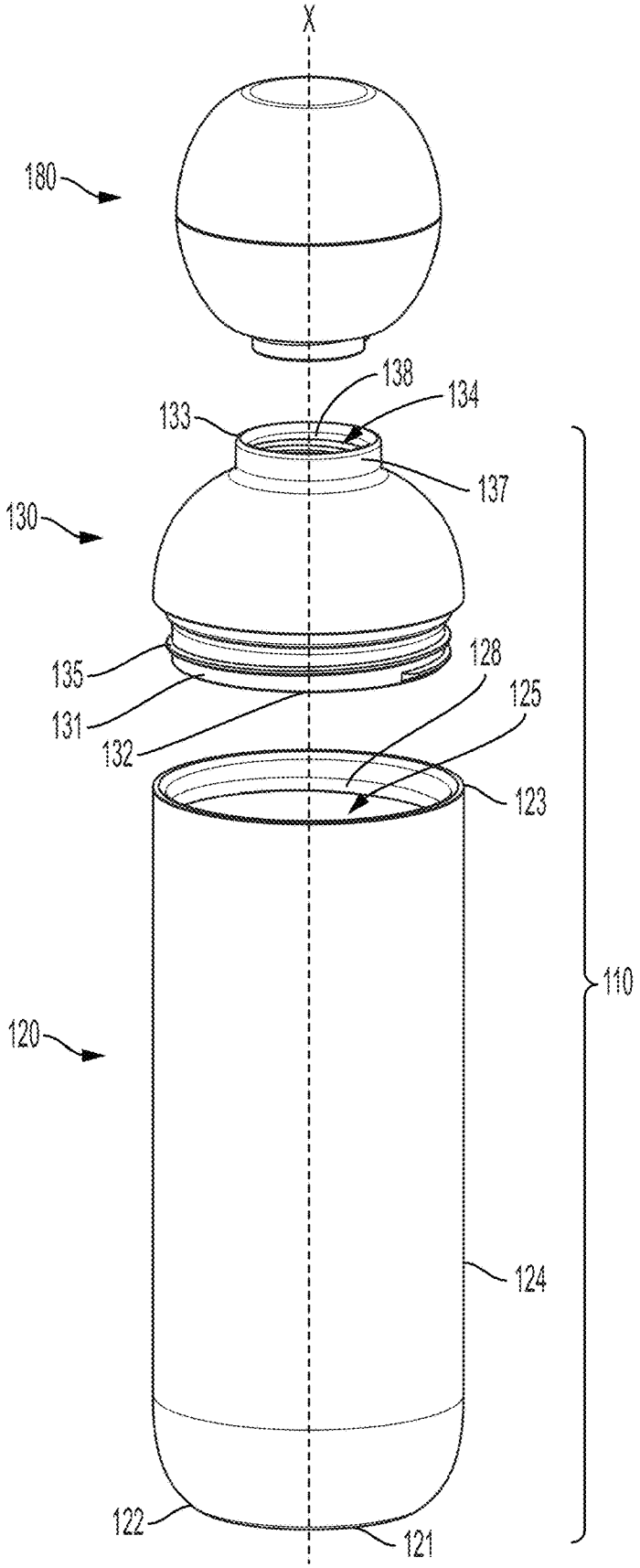
FIG. 1 shows a perspective view of components of a beverage container according to an embodiment, including a body portion, a neck portion, and a cap.

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring aspects of the disclosure.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

As used herein, the terms "upper" and "lower," and "top" and "bottom," and the like are intended to assist in understanding of embodiments of the invention with reference to the accompanying drawings with respect to the orientation of the beverage cartridge as shown, and are not intended to be limiting to the scope of the invention or to limit the invention scope to the embodiments depicted in the Figures. The directional terms are used for convenience of description and it is understood that a reusable beverage container, the components thereof, and a beverage-ingredient cartridge may be positioned in any of various orientations.

The following examples are illustrative, but not limiting, of the present disclosure. Other suitable modifications and adaptations of the variety of conditions and parameters normally encountered in the field, and which would be apparent to those skilled in the art, are within the spirit and scope of the disclosure.

Reusable beverage containers are increasingly popular as an environmentally-friendly alternative to single-use containers, such as plastic bottles. Consumers may fill and refill a reusable beverage container with a beverage for consumption throughout the day, such as by filling the container with water at a water fountain. However, a consumer may wish to drink more than one type of beverage throughout the day. The consumer may benefit from the option to fill their container with water or to prepare a flavored beverage. Many reusable beverage containers are simply used to store a beverage and do not provide additional functionality, such as the ability to dispense beverage ingredients from a beverage-ingredient cartridge. Thus, a container that may facilitate preparing a beverage from beverage ingredients (e.g., in addition to water) may be desirable to allow consumers to quickly and easily prepare such a beverage using a beverage container.

In some embodiments described herein, a reusable beverage container includes a vessel having an upper end defining an upper opening, and a cap removably securable to the upper end of the vessel to seal the upper opening. The cap includes a lower shell and an upper shell that are removably securable to one another so as to define an interior volume for receiving and completely enclosing a beverage-ingredient cartridge. The lower shell defines a lower opening such that when the cap is secured to the vessel, the interior volume of the cap is connected with the interior volume of vessel. The lower shell further includes a cartridge opener extending from the lower shell that is configured to engage the beverage-ingredient cartridge so as to cause a beverage ingredient stored within the cartridge to be dispensed from the cartridge into the vessel when a force is applied to press the cartridge onto the cartridge opener.

A reusable beverage container 100 includes a vessel 110 and a cap 180, as shown in FIG. 1. In some embodiments, vessel 110 includes a body portion 120 and a neck portion 130 that is removably securable to body portion 120. However, in some embodiments, body portion 120 and neck portion 130 are integrally formed such that vessel 110 has a one-piece construction. Body portion 120 includes a base 122 and a sidewall 124 extending from base 122. Body portion 120 defines an interior volume 127 for storing a beverage, such as water, carbonated water, a sports drink, juice, soda, tea, coffee, or milk, among various other beverages. Body portion 120 includes a lower end 121 opposite an upper end 123, and upper end 123 defines an opening 125. Body portion 120 may have a transverse cross sectional area that is circular, such that body portion 120 has a generally cylindrical shape. Body portion 120 need not be entirely cylindrical and in some embodiments sidewall 124 of body portion 120 may have, for example, a curvature so as to facilitate grasping or holding reusable beverage container 100. Further, body portion 120 may have various other shapes or configurations, such as a transverse cross sectional area that is an oval, ellipse, square, triangle, or rectangle, among other shapes.

Neck portion 130 of vessel 110 may be removably securable to body portion 120, as shown in FIG. 1. In such embodiments, neck portion 130 may include a lower end 131 opposite an upper end 133, wherein neck portion 130 tapers from lower end 131 toward upper end 133. In the illustrated embodiment, neck portion 130 has a dome-shape. In some embodiments, however, neck portion 130 may have other shapes, and for example may have a frustoconical shape. Lower end 131 of neck portion 130 defines a lower opening 132 having a first diameter, and upper end 133 defines an upper opening 134 having a second diameter that is less than the first diameter. Lower opening 132 of neck portion 130 may have the same or a similar diameter as opening 125 of body portion 120. Lower end 131 may include threading 135, such as external threading, configured to removably engage with internal threading 128 on an upper end 123 of body portion 120 so that neck portion 130 may be removably secured to body portion 120 via threaded connection. Alternatively, lower end 131 of neck portion 130 may include internal threading to engage with external threading on body portion 120. In some embodiments, neck portion 130 may be secured to body portion 120 via other types of connections, such as via a snap-fit connection, among other removable connections. When neck portion 130 is secured to vessel 110, reusable beverage container 100 may have a smooth, continuous surface at an interface of body portion 120 and neck portion 130. In some embodiments, neck portion 130 is not removable from body portion 120, however neck portion 130 may still have the characteristics (e.g., shape) described herein, save for those relating to its removability from body portion 130.

In some embodiments, neck portion 130 may further include a lip 137 extending upwardly from upper end 133 of neck portion 130 and which defines upper opening 134, as shown in FIG. 1. Lip 137 may be configured to engage with cap 180 for removably securing cap 180 to vessel 110. Lip 137 may include threading 138 configured to engage with threading 199 on cap 180 (see FIG. 3) for removably securing neck portion 130 of vessel 110 to cap 180.

Neck portion 130 may be removed from body portion 120, for example, to facilitate filling of body portion 120 (e.g., with a liquid and/or ice) or to facilitate washing vessel 110, as opening 125 of body portion 120 has a diameter that is larger than a diameter of upper opening 134 of neck portion 130. When neck portion 130 is secured to body portion 120, a consumer may drink from upper opening 134 of neck portion 130 which has a smaller diameter than opening 125 of body portion 120 and which may be better suited for sipping a beverage from vessel 110. However, it is understood that a beverage may alternatively be filled into vessel 110 via upper opening 134 of neck portion 130, and neck portion 130 need not be removed from base portion 120 for filling vessel 110. It is further understood that a consumer may drink from opening 125 of body portion 120 with neck portion 130 removed from body portion 120, if desired.

In some embodiments, vessel 110 is insulated so as to inhibit heat transfer into or out of vessel 110. Vessel 110 may have a double-walled construction to provide insulation. Further, in some embodiments, vessel 110 may be formed from a metal, such as stainless steel. An interior surface of vessel 110 may be coated, such as with a coating of copper, to provide further insulation for vessel 110. In some embodiments, neck portion 130 is formed from the same material as body portion 120, and thus may be formed of a metal, such as stainless steel. However, in alternate embodiments, neck portion 130 may be formed from a polymer or plastic, such as acrylonitrile butadiene styrene (ABS) or a polyamide, among other suitable materials.

A cap 180 may be removably secured to vessel 110 of reusable beverage container 100 so as to seal upper opening 134 at upper end 133 of neck portion 130. Cap 180 may be removed from vessel 110 to allow a consumer to drink a beverage stored within vessel 110. Cap 180 may be hollow so as to define an interior volume configured to receive and completely enclose a beverage-ingredient cartridge 500. Cap 180 may be shaped similarly to a shape of a beverage-ingredient cartridge 500. In some embodiments, cap 180 may have a spherical or spheroid shape so as to receive a beverage-ingredient cartridge 500 having a spherical or spheroid shape. As cap 180 is configured to receive cartridge 500, cap 180 may be somewhat larger than cartridge 500 so as to receive cartridge 500 within cap 180. However, in some embodiments, cap 180 may have any of various other shapes, and may be shaped as a cube, a rectangular prism, a pyramid, or a hemisphere, among various other shapes. Cap 180 may be formed from the same material as neck portion 130 of vessel 110. In some embodiments, cap 180 may be formed from a polymer or plastic, such as acrylonitrile butadiene styrene (ABS) or a polyamide, among other suitable materials.

When cap 180 is secured to vessel 110, cap 180 seals upper opening 134 of vessel 110 and cap 180 may be used as a handle or grip for carrying reusable beverage container 100. Thus, a consumer may carry beverage container 100 by cap 180 rather than by grasping body portion 120 of vessel 110. This may help to prevent heat transfer from the consumer's hand to the beverage, and may provide consumer with a more secure grip on reusable beverage container 100. Further, in embodiments in which cap 180 has a spherical or spheroid configuration, cap 180 may be particularly well-suited for being grasped in the palm of a consumer's hand with the consumer's fingers wrapped around the cap 180 to provide the consumer with comfortable and secure grip of reusable beverage container 100.

In embodiments in which cap 180 has a generally spherical or spheroid shape, cap 180 is connected such that a lower end of sphere is connected to vessel 110 to provide beverage container 100 with an appearance of a sphere or ball on top of vessel 110. In some embodiments—whether or not cap 180 has a spherical or spheroid shape—cap 180 may have a maximum diameter $D_M$ (e.g., in embodiments where cap 180 has a spherical or spheroid shape $D_M$ may be a maximum exterior diameter of such spherical or spheroid shape), cap 180 may be connected to vessel 110 at a portion of cap 180 having a diameter of $0.1D_M$ to $0.7D_M$, or $0.2D_M$ to $0.6D_M$. Thus, a consumer may place their fingers around the relatively narrow lower end of cap 180 at which cap 180 meets vessel 110, and the relatively larger higher portion in their hand (e.g., in embodiments where cap 180 has a spherical or spheroid shape, the user may grasp the spherical or spheroid "ball" shape in a palm of their hand). In some embodiments, maximum diameter of cap 180 may be 1 inch to 3 inches, or 1.25 inches to 2.75 inches, or 1.5 inches to 2.5 inches.

In some embodiments, cap 180 can have a maximum diameter that is greater than a diameter of upper opening 134 and less than a maximum diameter of body portion 120 of vessel 110. In some embodiments, upper opening 134 may have a diameter that is at least 0.5 inches to a maximum that is equal to a diameter of vessel 110, which may be for example, 2.5 inches, 3 inches, or 3.5 inches. In some embodiments, maximum diameter of cap 180 may be 10% to 600% greater than a diameter of upper opening 134 of vessel 110, or may be 50% to 300% greater than a diameter of upper opening 134 of vessel 110, or may be 75% to 250% greater than a diameter of upper opening 134 of vessel 110. In this way, cap 180 widens from its lower end connected to vessel 110 at upper opening 134 toward a mid-portion of cap 180 having the maximum diameter, and, in some embodiments, diameter of cap 180 decreases or tapers from mid-portion toward an upper end 205 of cap 180. Thus, beverage container 100 is narrowest at upper opening 134 as neck portion 130 of vessel 110 tapers from lower end 131 towards upper end 133 and upper opening 134, and lower shell 190 of cap 180 widens from lower end 191 to upper end 193, creating a narrowed region to be grasped by the consumer. In embodiments in which cap 180 is a spherical shape as described above, cap 180 may be easily grasped by a consumer by grasping cap 180 in a palm of consumer's hand such that the consumer's fingers wrap around cap 180 and are positioned adjacent lower end of cap 180 having a reduced diameter.

Figure 2:
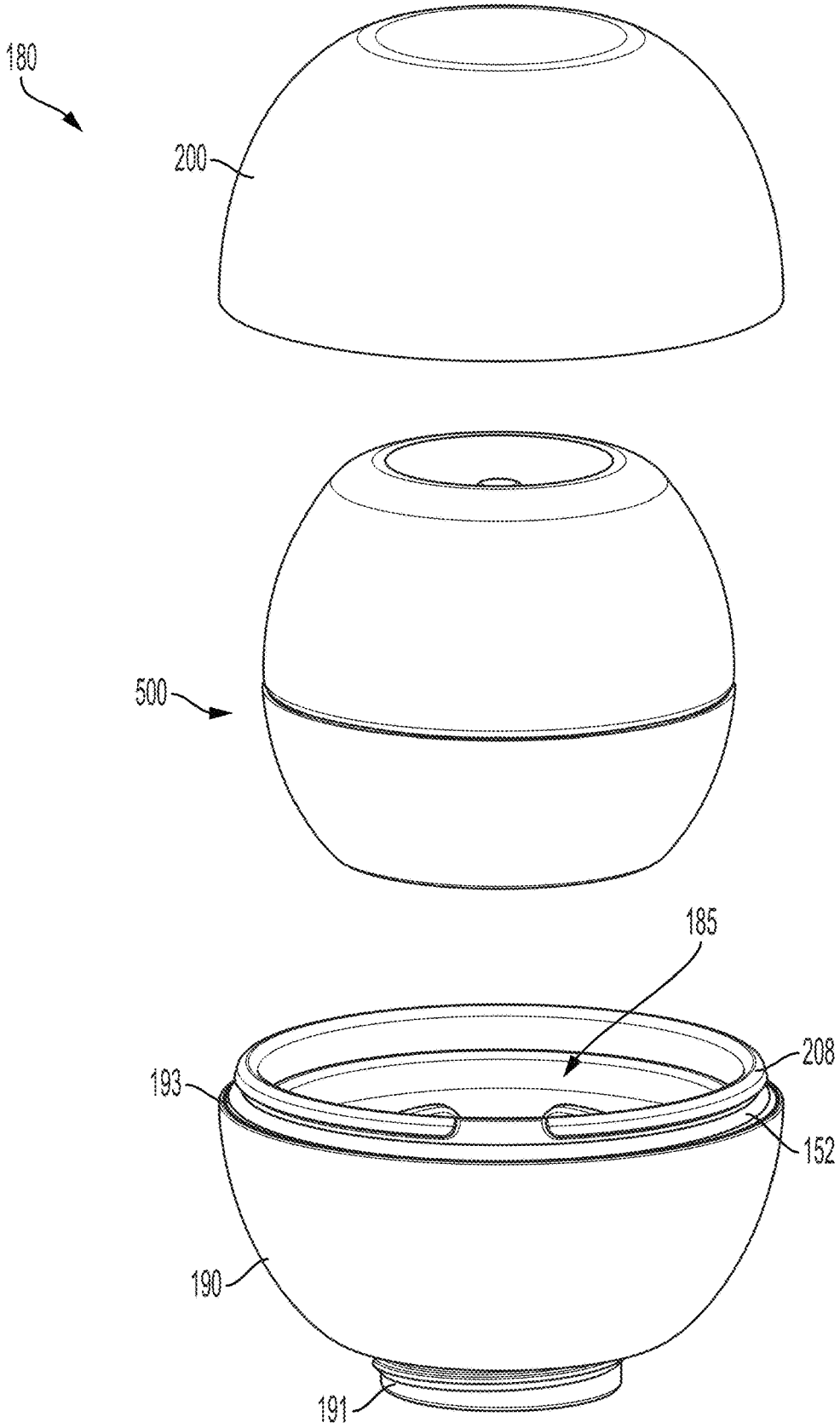
FIG. 2 shows a perspective view of the cap of FIG. 1 and a beverage-ingredient cartridge.

In some embodiments, cap 180 includes a lower shell 190 and an upper shell 200 that are removably securable to one another, as shown in FIG. 2. Lower shell 190 may widen from a lower end 191 toward an upper end 193, such that a diameter $D_1$ of lower end 191, which is similar in diameter to upper opening 134 of vessel 110, is smaller than a diameter $D_2$ of upper end 193 of lower shell 190. Upper shell 200 may have a lower end 204 that is approximately the same diameter $D_2$ as upper end 193 of lower shell 190, and upper shell 200 tapers from lower end 204 toward an upper end 205. Lower shell 190 and upper shell 200 of cap 180 define an interior volume 185 that is bounded by lower shell 190 and upper shell 200. Cap 180 may be divided into lower shell 190 and upper shell 200 about a plane that is transverse to a longitudinal axis X of reusable beverage container 100 (e.g., when cap 180 is attached to vessel 110). Each of lower shell 190 and upper shell 200 may form approximately half of cap 180, such that a part line 203 between them is within the middle 25% of the height of cap 180 in the direction of longitudinal axis X (see FIG. 4). In some embodiments, for example, lower shell 190 and upper shell 200 may each have a generally hemispherical shape.

Figure 3:
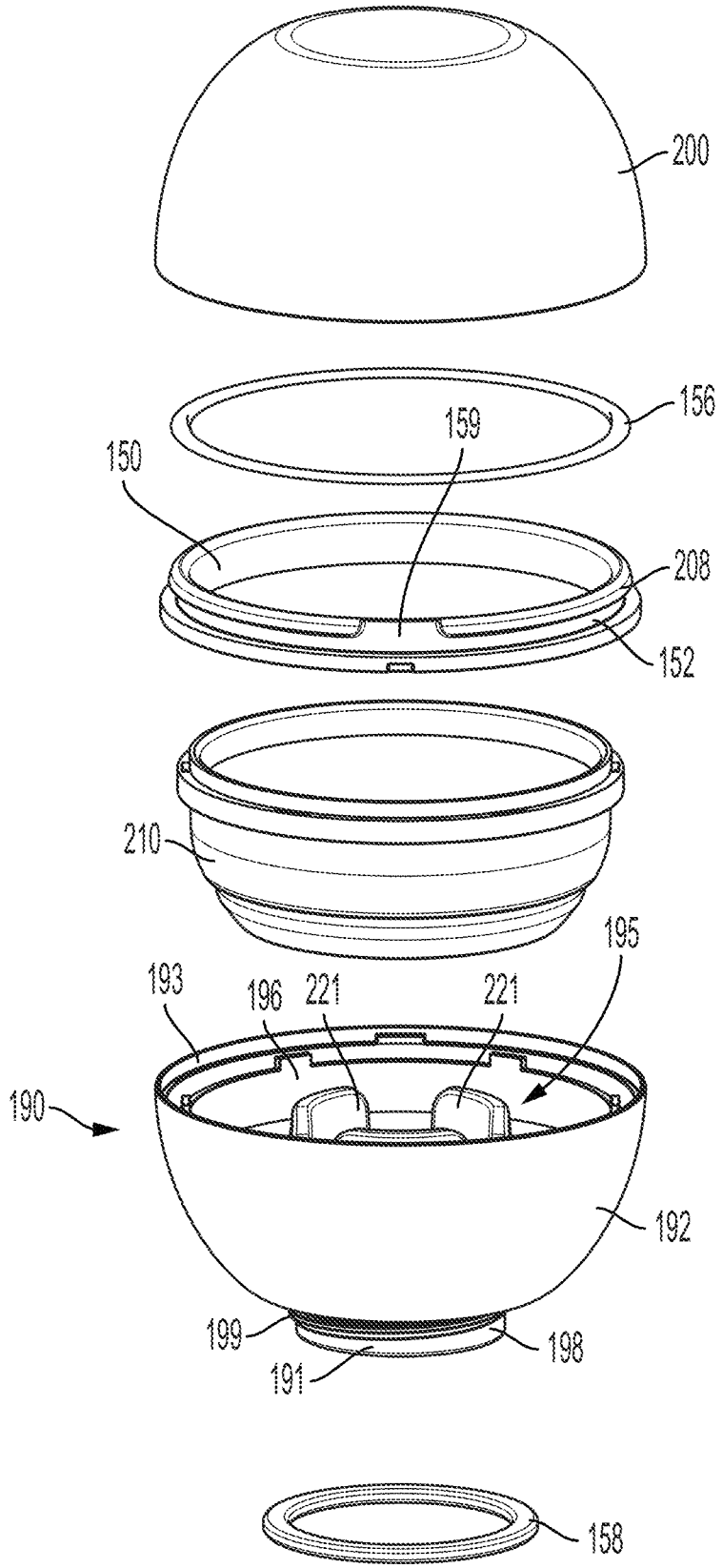
FIG. 3 shows an exploded view of the cap of FIG. 1.

In some embodiments, lower shell 190 may be connected to upper shell 200 by a snap-fit connection. However, lower shell 190 may be secured to upper shell 200 via press fit or interference fit, among other types of removable connection known in the art. In some embodiments, lower shell 190 may be connected to upper shell 200 via a connection ring 150, as best shown in FIG. 3. Connection ring 150 may be configured to connect upper shell 200 to lower shell 190 via the snap-fit connection. Connection ring 150 may be arranged at an upper end 193 of lower shell 190. Connection ring 150 may be secured to an interior surface 196 of upper end 193 of lower shell 190, and connection ring 150 may extend above an upper end 193 of lower shell 190. In order to provide a snap-fit connection, connection ring 150 may have a groove 152 extending circumferentially around connection ring 150 to engage with a protrusion 202 on an interior surface 201 of upper shell 200.

Figure 4:
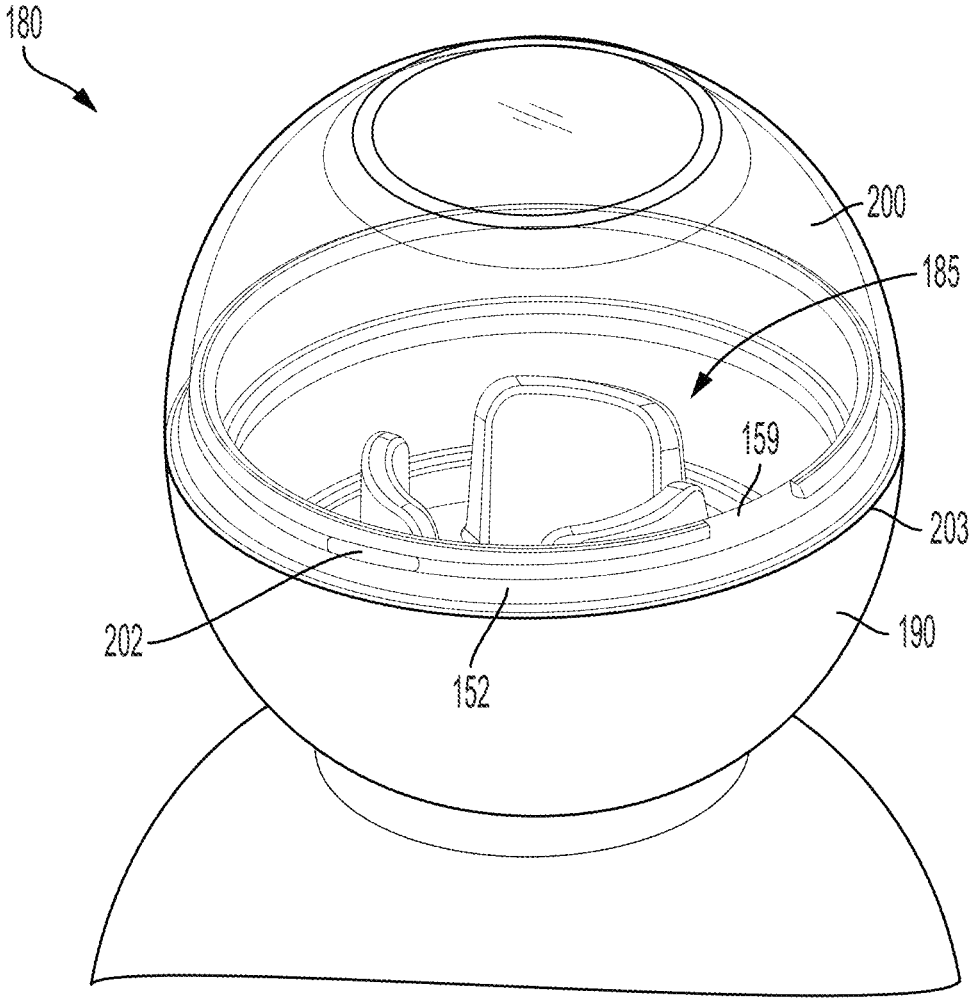
FIG. 4 shows a partial perspective view of the beverage container of FIG. 1, with a portion of the cap shown transparent.

In some embodiments, upper shell 200 of cap 180 may be secured to lower shell 190 by a twist-lock connection, as shown in FIG. 4, which may optionally also include a snap-fit connection. In such embodiments, upper shell 200 includes a protrusion 202 on an interior surface thereof. Protrusion 202 is configured to slide within a groove 152 of connection ring 150. Connection ring 150 further includes a groove opening 159. When upper shell 200 is secured to lower shell 190, protrusion 202 of upper shell 200 is secured within groove 152 of connection ring 150. By twisting or rotating upper shell 200 relative to lower shell 190, protrusion 202 may slide within groove 152 of connection ring 150. When protrusion 202 is positioned at location of groove 152 having groove opening 159, protrusion 202 may escape from groove 152 so that upper shell 200 can be removed from lower shell 190. Similarly, to secure upper shell 200 to lower shell 190, a consumer can align protrusion 202 of upper shell 200 with groove opening 159 of connection ring 150, insert protrusion 202 into groove 152 through groove opening 159, and rotate upper shell 200 so that protrusion 202 is positioned within groove 152 distant from groove opening 159. Alternatively, a consumer may snap the protrusion 202 of upper shell 200 over a ridge 208 of connection ring 150 that defines groove 152 in order to position protrusion 202 within groove 152. Once protrusion 202 is captured within groove 152, protrusion 202 cannot escape groove 152 unless aligned with groove opening 159. In some embodiments, ridge 208 may have an inclined upper surface so as to allow protrusion 202 to pass over ridge 208 and enter groove 152. Further, in such embodiments, upper shell 200 may be transparent such that an interior volume of cap 180 and location of protrusion 202 of upper shell 200 is more easily viewed by the consumer.

In some embodiments, a seal ring 156 may be positioned around a circumference of connection ring 150 as shown in FIG. 3. Seal ring 156 helps to form a liquid-tight seal with upper shell 200 when upper shell 200 is removably secured to lower shell 190 in order to prevent any liquid from leaking out of cap 180. In some embodiments, seal ring 156 may be secured to an interior surface 201 of upper shell 200, as shown for example in FIG. 7. Seal ring 156 may be secured within a groove on interior surface 201 of upper shell 200. Incorporating seal ring 156 as part of upper shell 200 may help to secure upper shell 200 to lower shell 190 when there is no beverage-ingredient cartridge 500 within cap 180.

Cap 180 may be removably secured to vessel 110 by lower shell 190. Lower shell 190 includes a body 192 having a lower end 191 and an upper end 193. Lower shell 190 may widen from lower end 191 toward upper end 193. Lower shell 190 may define a lower opening 194 at lower end 191 of body 192. Thus, when lower shell 190 is secured to vessel 110, an interior volume 185 of cap 180 is connected to (e.g., in fluid communication with) an interior volume of vessel 110 via lower opening 194. Lower shell 190 may include a neck 198 at lower end 191 that defines opening 194. Neck 198 may include threading 199 on an exterior surface of neck 198 for engaging with threading 138 on an interior surface of upper end 133 of vessel 110, such as threading 138 of lip 137 of neck portion 130. It is understood, however, that threading may alternatively be provided on an interior surface of neck 198 of lower shell 190 and on an exterior surface of upper end 133 of vessel 110.

Figure 5:
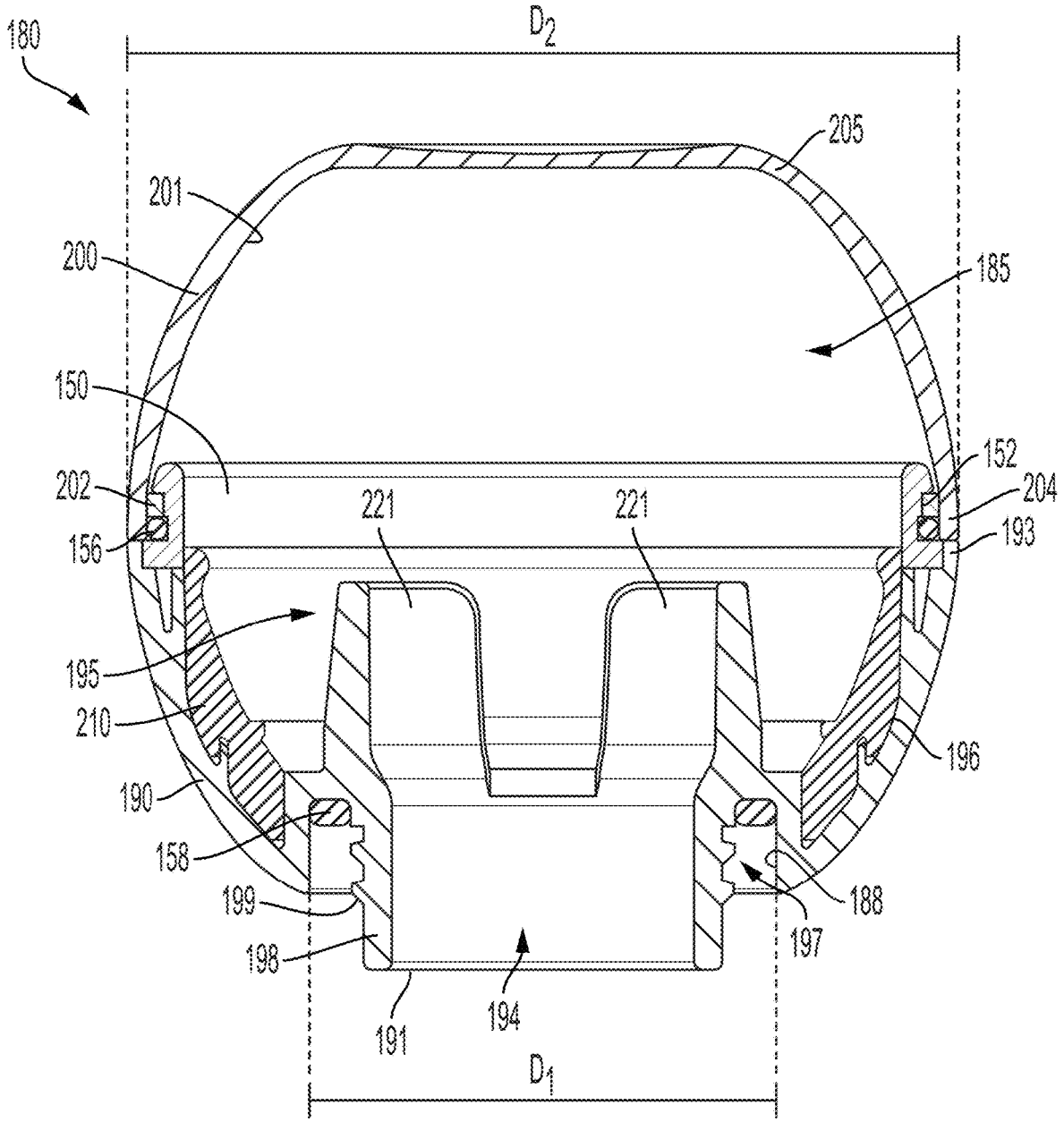
FIG. 5 shows a longitudinal cross-sectional view of the cap of FIG. 1.

In some embodiments, lower shell 190 may further include a recess 197 surrounding neck 198 for receiving an upper end of vessel 110, as shown in FIG. 5. Recess 197 may be configured to receive lip 137 of neck portion 130 when cap 180 is removably secured to neck portion 130 of vessel 110. A seal ring 158 may be positioned within recess 197 of lower shell 190 to provide a liquid-tight connection between cap 180 and vessel 110 when cap 180 is secured to vessel 110 in order to prevent liquid from escaping at the interface of the cap 180 and vessel 110 (see, e.g., FIG. 7).

When cap 180 is secured to vessel 110, lip 137 of neck portion 130 is inserted into recess 197 of cap 180 such that lip 137 may be partially or fully obscured by lower shell 190, and in turn neck 198 of lower shell 190 is inserted into upper opening 134 of vessel 110. In this way, when cap 180 is connected to vessel 110, beverage container 100 has a smooth and unitary appearance with no connecting structures visible to a consumer (see FIG. 7). Thus, lower end 191 of lower shell 190 of cap 180 extends within neck portion 130 of vessel 110 (e.g., entirely through, and in some embodiments extending past neck portion 130). By obscuring the connections, e.g., threading 138, 199, cap 180 may be comfortably grasped by a consumer for carrying beverage container 100 without interference from connecting structures.

Figure 6:
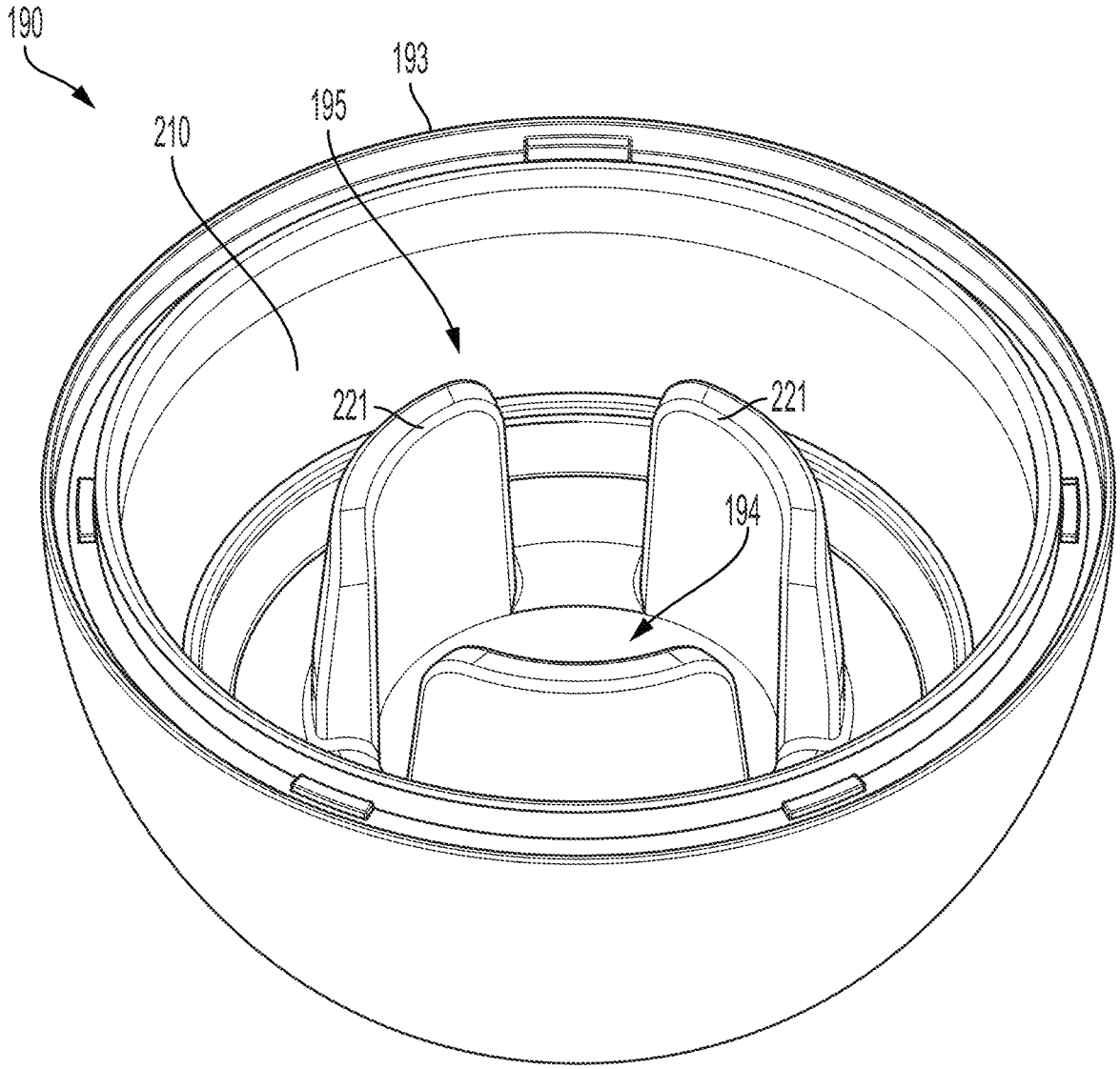
FIG. 6 shows a perspective view of the lower shell of the cap of FIG. 1.

Lower shell 190 further includes a cartridge opener 195 configured to facilitate dispensing of beverage ingredients from beverage-ingredient cartridge 500, as best shown in FIGS. 5 and 6. Cartridge opener 195 is configured to push against a portion of beverage-ingredient cartridge 500 in order to open cartridge 500 (e.g., by dislodging or displacing a portion of cartridge 500 to create a flow path for beverage ingredients to escape cartridge 500, or by tearing or causing to be torn a film of cartridge 500, depending upon the type of cartridge 500 used).

In some embodiments, cartridge opener 195 extends inwardly from a lower end 191 of lower shell 190 toward an upper end 193 of lower shell 190. Cartridge opener 195 may be formed as one or more projections 221 spaced around lower opening 194, as best shown in FIG. 6. In such embodiments, upwardly-extending projections 221 of cartridge opener 195 may be positioned around lower opening 194 that is centrally positioned on lower shell 190. When a cartridge (e.g., cartridge 500) is pressed against projections 221 projections 221 may force open the cartridge (e.g., by displacing a portion of the cartridge, or by tearing or puncturing a plastic film of the cartridge), depending upon the type of cartridge 500 used. In some embodiments, as shown, for example, in FIG. 6, cartridge opener 195 may have three projections 221, each forming part of a circular shape, and disposed evenly around a centrally positioned lower opening 194. In this way, when a cartridge 500 is opened by cartridge opener 195, projections 221 may extend into the cartridge 500, and the contents of cartridge 500 can be dispensed out of cartridge 500 and through lower opening 194 (e.g., into vessel 110).

In some embodiments, cartridge opener 195 may instead be formed as a single projection extending above opening 194 of lower shell 190. In such embodiments, cartridge opener 195 may have a pointed upper end for contacting cartridge 500, and cartridge opener 195 may be shaped, for example, as a pyramid, a post, or a spike. In some embodiments, cartridge opener 195 may have a cross-shaped transverse cross sectional area, and may have a pointed upper end.

In some embodiments, lower shell 190 may further include an inner seal 210. When cartridge 500 is positioned in lower shell 190 for dispensing beverage ingredients, cartridge 500 presses against inner seal 210 so as to form a seal that prevents liquid in vessel 110 from entering an interior volume of cap 180 outside of a cartridge 500 through lower opening 194 (e.g., flowing along an exterior of cartridge 500). Inner seal 210 is positioned on an interior surface 196 of lower shell 190. Inner seal 210 may have an annular shape that contours to interior surface 196, and thus may have a generally hemispherical shape. Further, inner seal 210 is positioned on interior surface 196 and extends around cartridge opener 195 and lower opening 194 of lower shell 190. Inner seal 210 may be formed from a flexible and/or compressible material with good sealing properties, such as, for example, silicone or rubber. Inner seal 210 may be co-molded or over-molded with lower shell 190. In some embodiments, inner seal 210 may be formed separately from lower shell 190 and assembled as part of cap 180. In such embodiments, inner seal 210 may be disposed within lower shell 190 without any further attachment to lower shell 190 (e.g., so that it can be easily removed, for example, to be washed), or may be secured to lower shell 190 by glue, adhesives, bonding, welding, among other fastening methods.

While reusable beverage container 100 may receive a cap 180 as described herein for dispensing beverage ingredients from a beverage-ingredient cartridge 500, beverage container 100 may be configured to receive alternate types of caps 180. A consumer may wish to use different caps at different times. For example, a cap that simply seals vessel 110 without providing the functionality of dispensing beverage-ingredients from a cartridge 500 may be desired where the consumer wishes to save space or when the consumer wishes to use the vessel 110 to simply store water or other pre-made beverages. Further, a consumer may prefer a cap having a particular shape, geometry, or size for use in carrying the reusable beverage container 100, or which provides a desired aesthetic appearance.

Similarly, cap 180 may be removably securable to other beverage containers, such as existing plastic bottles. In some embodiments, for example, cap 180 may be securable to a single-use plastic bottle. Many single-use plastic beverage bottles have a common standard diameter and thread configuration. Cap 180 can be formed to mate with one of these common standard diameter and thread configurations, or may be used with a threaded adapter that allows cap 180 to sealably attach to one of these common standard diameter and thread configurations. Thus, cap 180 can be used to allow a consumer to dispense beverage ingredients from a cartridge 500 into any of various bottles that are shaped and sized to receive cap 180. Further, cap 180 may be sized and shaped so as to engage with the upper end, e.g., the mouth, of existing plastic bottles and containers, with or without an adapter.

Figure 7:
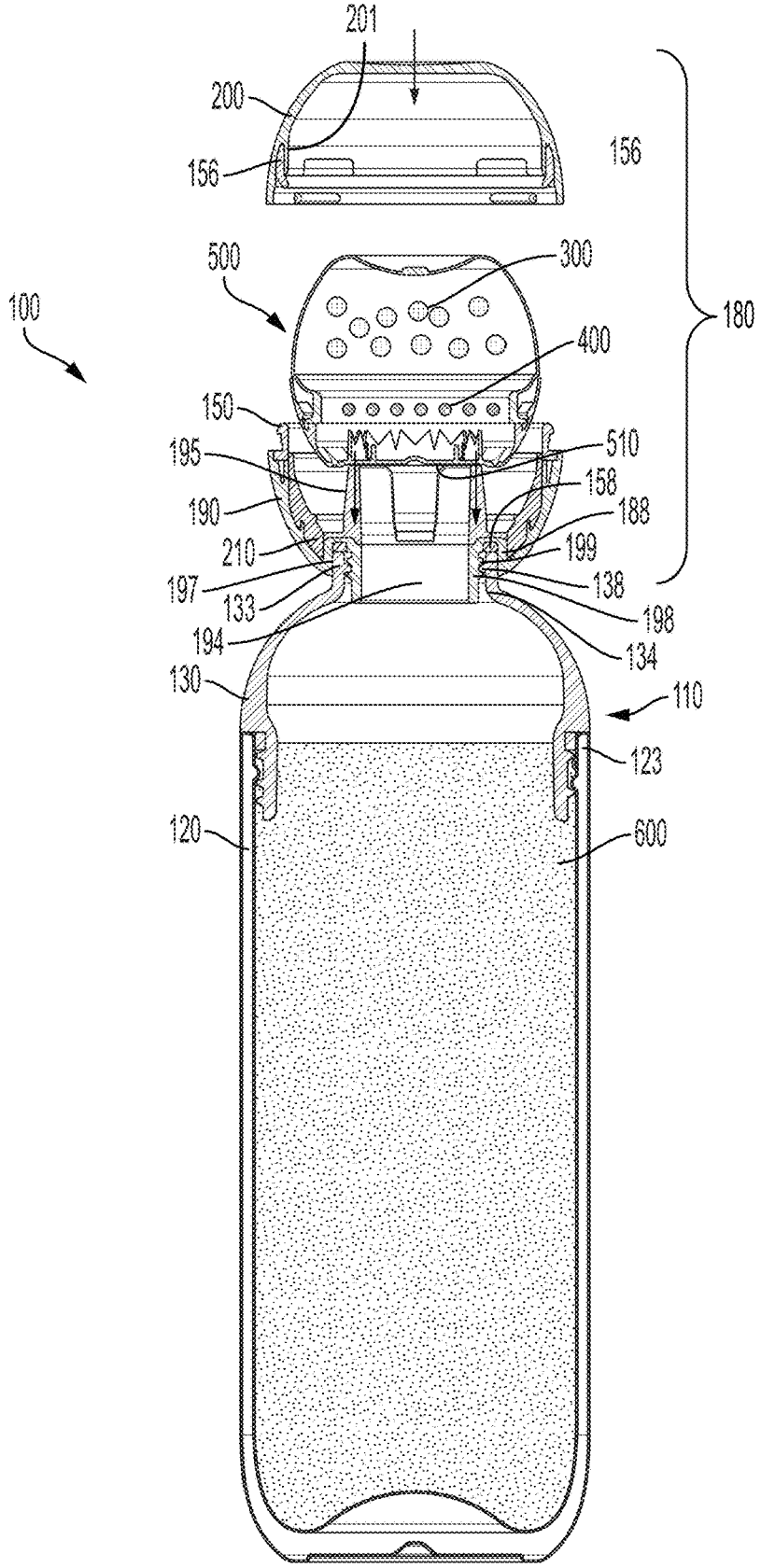
FIG. 7 shows a longitudinal cross-sectional view of a beverage-ingredient cartridge in use with the beverage container of FIG. 1.
Figure 8:
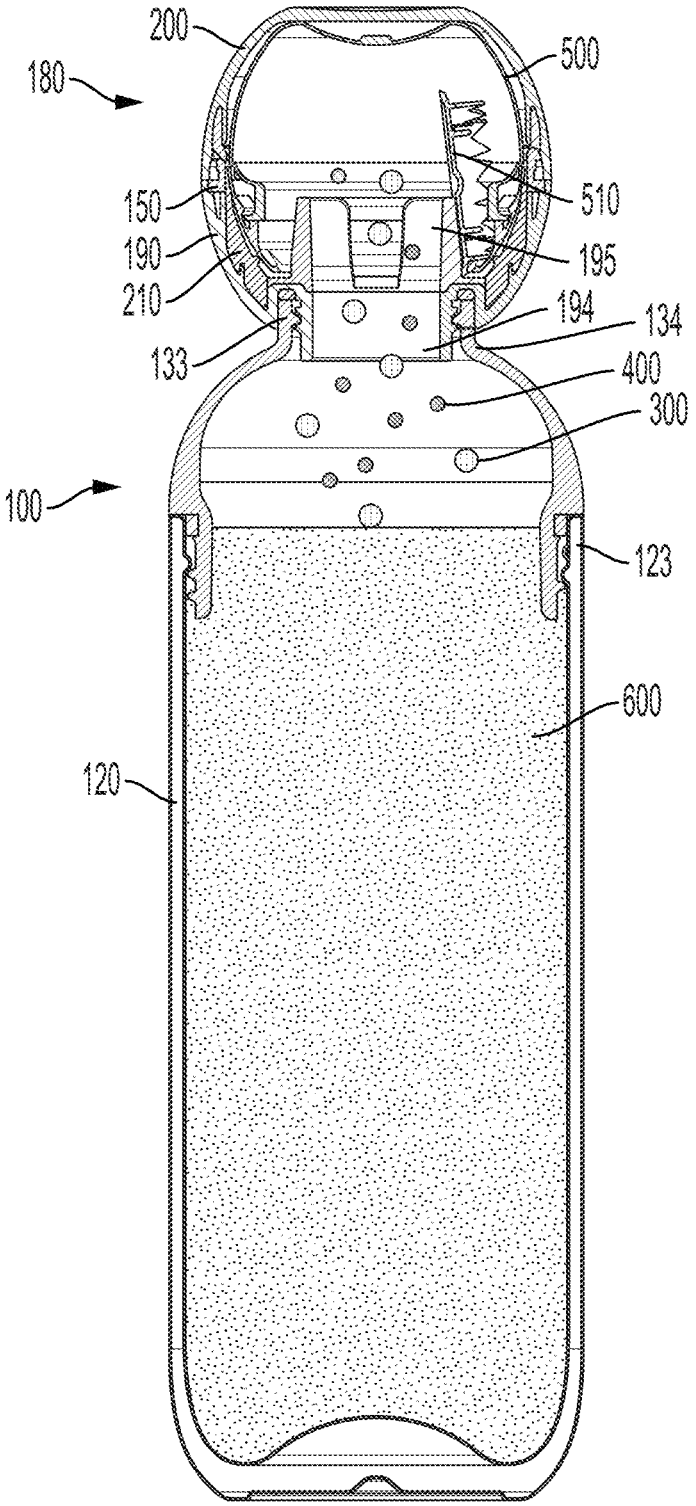
FIG. 8 shows a longitudinal cross-sectional view of a beverage-ingredient cartridge in use with the beverage container of FIG. 1.

An exemplary method of operating reusable beverage container 100 to prepare a beverage using a beverage-ingredient cartridge 500 is shown in FIGS. 7 and 8. In operation, body portion 120 of vessel 110 may be filled with a liquid 600, such as liquid water, and optionally other substances, such as ice, for example. Neck portion 130 may be secured to upper end 123 of body portion 120 of vessel 110, such as by engaging threading on neck portion 130 with threading on body portion 120. Alternatively, the consumer may fill vessel 110 via upper opening 134 of neck portion 130, without removing neck portion 130 from body portion 120, such as in embodiments in which body portion 120 and neck portion 130 are integrally formed, or simply if the consumer prefers to fill via upper opening 134 rather than via opening 125 of body portion 120.

Cap 180 may be removably secured to upper end 133 of neck portion 130 of vessel 110 for sealing upper opening 134 until the consumer wishes to drink the beverage within vessel 110. Cap 180 may be secured to upper end 133 of neck portion 130 by engaging threading 199 on neck 198 of lower shell 190 of cap 180 (e.g., exterior threading, as shown) with threading 138 on upper end 133 of neck portion 130 (e.g., interior threading, as shown). Cap 180 provides a liquid-tight seal and when threading 138 on upper end 133 of neck portion 130 of vessel 110 is engaged with threading 199 on lower shell 190 of cap 180, and further recess 197 may include a seal ring 158 therein that contacts upper end 133 of neck portion 130 when neck portion 130 is inserted into recess 197. Further, the arrangement of threading 138 of neck portion 130 as interior threading, and of threading 199 of cap 180 as exterior threading helps allow more direct access from cap 180 through upper end 133 of neck portion 130 and into vessel 110, since it can provide a smooth transition into the interior (e.g., for beverage ingredients to traverse) without interference from connection structures (e.g., threads).

The consumer may select a beverage-ingredient cartridge 500 that stores one or more beverage ingredients 300, 400, and the beverage ingredients may be in powder or liquid form. Cartridge 500 may have a spherical or spheroid shape. Cartridge 500 may include an opening covered by a seal 510, such as a plastic film or a displaceable component, such that beverage ingredients 300, 400 can be released from cartridge 500 upon application of a force to seal 510 of cartridge 500.

In order to prepare a beverage using reusable beverage container 100 and a beverage-ingredient cartridge 500, upper shell 200 of cap 180 can be removed from lower shell 190, with lower shell 190 still secured to neck portion 130 of vessel 110. Beverage-ingredient cartridge 500 may be positioned with its seal 510 facing downward, such that seal 510 of cartridge 500 is in contact with cartridge opener 195 of lower shell 190, as shown in FIG. 7.

Upper shell 200 may be placed on top of cartridge 500 and a force may be applied along a longitudinal axis of cartridge 500 and of reusable beverage container 100 so as to push cartridge 500 into cartridge opener 195 in a direction toward vessel 110. As the force is applied to upper shell 200 and upper shell 200 moves toward engagement with lower shell 190, upper shell 200 in turn applies a force to cartridge 500 to open cartridge 500 to dispense the beverage ingredients. When upper shell 200 reaches lower shell 190, upper shell 200 connects to lower shell 190, engaging with lower shell 190 by, for example, snap-fit, such that beverage-ingredient cartridge 500 is sealed within cap 180, as shown in FIG. 8. In some embodiments, upper shell 200 may be unable to connect to lower shell 190 until cartridge opener 195 penetrates cartridge 500. In such embodiments, cap 180 may be sized so as to be only slightly larger than beverage-ingredient cartridge 500 so as to fit closely against beverage-ingredient cartridge 500 positioned within cap 180. However, prior to penetrating cartridge 500, cartridge 500 is positioned on top of cartridge opener 195. In some embodiments, cartridge opener 195 may have a height that is at least about 50% of a height of lower shell 190. Thus, the combined height of cartridge 500 seated on top of cartridge opener 195 is too great to allow upper shell 200 to contact lower shell 190, such that cartridge 500 is forced open when upper shell 200 is brought into contact with lower shell 190.

As mentioned above, while upper shell 200 is in the process of being closed (e.g., engaging with lower shell 190) with a cartridge 500 positioned against cartridge opener 195 of lower shell 190, cartridge opener 195 pushes against seal 510 of cartridge 500, and upon sufficient application of force, cartridge opener 195 punctures or enters cartridge 500 and causes beverage ingredients 300, 400 to be dispensed from cartridge 500 (see FIG. 8) while upper shell 200 descends and ultimately engages with lower shell 190, sealing cartridge 500 within interior volume 185. Beverage ingredients 300, 400 may be dispensed by displacing a portion of cartridge 500, or by tearing or puncturing a plastic film of cartridge 500, depending upon the type of cartridge 500 used. As beverage ingredients 300, 400 are released from cartridge 500, beverage ingredients 300, 400 may pass through lower opening 194 of lower shell 190 of cap 180 and into vessel 110 of reusable beverage container 100. In an upright orientation of beverage container 100, as shown in FIGS. 7 and 8, cartridge 500 is inverted within interior volume 185, with an opening thereof facing downward, so beverage ingredients 300, 400 may pass from cartridge 500 into vessel 110 under the force of gravity. Beverage ingredients 300, 400 may mix with liquid 600 within vessel 110 so as to form a beverage.

The consumer may shake reusable beverage container 100 so as to mix beverage ingredients 300, 400 and liquid 600 to form the beverage. Because beverage-ingredient cartridge 500 is enclosed within cap 180, cartridge 500 is in contact with inner seal 210 of lower shell 190 so as to form a seal that prevents liquid from passing from vessel 110 through lower opening 194 of lower shell 190 and into cap 180 along an exterior surface of cartridge 500. After mixing the beverage ingredients and the liquid, cap 180 may be removed from vessel 110 so that a consumer may drink the beverage from vessel 110. Cap 180 serves to store the used beverage-ingredient cartridge 500 such that cap 180 may continue to be used to seal upper opening 134 of vessel 110, and cartridge 500 can be stored in cap 180 until a consumer wishes to remove and dispose of cartridge 500 (e.g., in a recycling receptacle). The ability to store a used or spent cartridge 500 within cap 180 may be beneficial so that the consumer does not have to separately carry or store the used cartridge 500, especially in circumstances in which a receptacle for appropriately disposing of the cartridge may not be readily available at the location where the consumer prepares the beverage.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventors, and thus, are not intended to limit the present invention(s) and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, and without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance herein.

The breadth and scope of the present invention(s) should not be limited by any of the above-described exemplary embodiments, but should be defined only in accordance with the claims and their equivalents.

What is claimed is:

1. A reusable beverage container, comprising:

a vessel having an upper end that defines an upper opening, wherein the vessel is configured to store a beverage;

a cap removably securable to the upper end of the vessel, wherein the cap is configured to receive and completely enclose a beverage-ingredient cartridge, the cap comprising:

a lower shell having an upper end and a lower end, wherein the lower end defines a lower opening;

an upper shell removably securable to the upper end of the lower shell; and a cartridge opener extending from the lower shell, wherein the lower shell comprises an inner seal arranged on an interior surface of the lower shell, and wherein the inner seal is configured to form a seal with the beverage-ingredient cartridge when the beverage-ingredient cartridge is positioned within the lower shell and in contact with the inner seal so as to prevent liquid from passing through the lower opening and into an interior volume of the cap outside of the beverage-ingredient cartridge.

2. The reusable beverage container of claim 1, wherein the vessel comprises:

a body portion; and a neck portion removably securable to the body portion, wherein the neck portion defines the upper opening at the upper end of the vessel, and wherein the neck portion comprises a first diameter at a lower end of the neck portion and a second diameter at an upper end of the neck portion, wherein the first diameter is greater than the second diameter.

3. The reusable beverage container of claim 1, wherein the lower shell comprises a neck having threading that is configured to be removably secured to threading on the upper end of the vessel.

4. The beverage container of claim 3, wherein the lower shell comprises a recess surrounding the neck, wherein the recess is configured to receive a lip of the upper end of the vessel.

5. The reusable beverage container of claim 1, wherein when the lower shell is secured to the vessel, a neck of the lower shell extends into the upper opening of the vessel.

6. The reusable beverage container of claim 1, wherein the cartridge opener extends from the lower shell around the lower opening toward the upper end of the lower shell.

7. The reusable beverage container of claim 1, further comprising a connection ring at the upper end of the lower shell, wherein the connection ring defines a groove configured to receive a ridge of the upper shell to removably secure the upper shell to the lower shell via a snap-fit connection.

8. The reusable beverage container of claim 1, wherein the lower shell widens from the lower end of the lower shell toward the upper end of the lower shell.

9. The reusable beverage container of claim 1, wherein the cap has a maximum diameter that is greater than a diameter of the upper opening of the vessel.

10. The reusable beverage container of claim 1, wherein the cap comprises a generally spherical shape.

11. The reusable beverage container of claim 1, wherein the inner seal comprises an annular shape.

12. A system for making a beverage, comprising:

the reusable beverage container of claim 1; and the beverage-ingredient cartridge containing a beverage ingredient;

wherein when the beverage-ingredient cartridge is engaged with the cartridge opener of the cap, the cartridge opener displaces a portion of the beverage-ingredient cartridge so as to release the beverage ingredient into the vessel of the reusable beverage container under the force of gravity.

13. A reusable beverage container, comprising:

a vessel having an opening and configured to store a beverage;

a cap removably securable to the vessel to seal the opening, wherein the cap comprises:

a lower shell defining a lower opening such that an interior volume of the cap is connected with an interior volume of the vessel, and wherein the lower shell is configured to receive a beverage-ingredient cartridge containing a beverage ingredient;

a cartridge opener extending from the lower shell that is configured to contact the beverage-ingredient cartridge received by the lower shell such that when a force is applied to the beverage-ingredient cartridge, the cartridge opener dispenses the beverage ingredient from the beverage-ingredient cartridge into the vessel; and an upper shell removably securable to an upper end of the lower shell, wherein the lower shell comprises an inner seal arranged on an interior surface of the lower shell, and wherein the inner seal is configured to form a seal with the beverage-ingredient cartridge when the beverage-ingredient cartridge is received by the lower shell and in contact with the inner seal so as to prevent liquid from passing through the lower opening and into an interior volume of the cap outside of the beverage-ingredient cartridge.

14. The reusable beverage container of claim 13, wherein when the upper shell is removably secured to the lower shell, the beverage-ingredient cartridge is enclosed within the cap.

15. The reusable beverage container of claim 13, wherein when the upper shell is secured to the lower shell, the upper shell applies a force on the beverage-ingredient cartridge such that the beverage-ingredient cartridge pushes against the cartridge opener.

16. The reusable beverage container of claim 13, wherein the cartridge opener is configured to extend into an interior volume of the beverage-ingredient cartridge in order to dispense the beverage ingredient from the beverage-ingredient cartridge.

17. The reusable beverage container of claim 13, wherein the cap comprises a generally spherical shape.

18. The reusable beverage container of claim 13, wherein the inner seal comprises an annular shape.

19. A system for making a beverage, comprising:

the reusable beverage container of claim 13; and the beverage-ingredient cartridge containing a beverage ingredient;

wherein when the beverage-ingredient cartridge is engaged with the cartridge opener, the cartridge opener displaces a portion of the beverage-ingredient cartridge so as to release the beverage ingredient into the vessel of the reusable beverage container under the force of gravity.

20. The system of claim 19, wherein the upper shell is securable to the lower shell once the cartridge opener displaces a portion of the beverage-ingredient cartridge.

* * * * *